US007645302B2

(12) United States Patent
Deng et al.

(10) Patent No.: US 7,645,302 B2
(45) Date of Patent: Jan. 12, 2010

(54) BLEACHING COMPOSITIONS

(75) Inventors: Dao-Li Deng, Shanghai (CN); Matthew Elliot Helton, Wirral (GB); Xiao-Hong Wang, Shanghai (CN); Wei Zhao, Shanghai (CN)

(73) Assignee: The Sun Products Corporation, Wilton, CT (US)

( * ) Notice: Subject to any disclaimer, the term of this patent is extended or adjusted under 35 U.S.C. 154(b) by 20 days.

(21) Appl. No.: 11/885,532

(22) PCT Filed: Jan. 20, 2006

(86) PCT No.: PCT/EP2006/000509

§ 371 (c)(1),
(2), (4) Date: Jun. 6, 2008

(87) PCT Pub. No.: WO2006/094577

PCT Pub. Date: Sep. 14, 2006

(65) Prior Publication Data

US 2009/0019643 A1 Jan. 22, 2009

(30) Foreign Application Priority Data

Mar. 3, 2005 (GB) ..... 0504439.1
Mar. 3, 2005 (GB) ..... 0504440.9

(51) Int. Cl.

| | |
|---|---|
| ***D06L 3/02*** | (2006.01) |
| ***D06L 3/16*** | (2006.01) |
| ***C11D 1/00*** | (2006.01) |
| ***C11D 3/34*** | (2006.01) |
| ***C11D 3/20*** | (2006.01) |
| ***C11D 3/395*** | (2006.01) |

(52) U.S. Cl. ..... 8/110; 8/111; 510/302; 510/303; 510/311; 510/370; 510/376; 510/492; 510/505

(58) Field of Classification Search ..... 8/110, 8/111; 510/302, 303, 311, 370, 376, 492, 510/505

See application file for complete search history.

(56) References Cited

U.S. PATENT DOCUMENTS

| | | | | |
|---|---|---|---|---|
| 5,041,142 | A | 8/1991 | Ellis | 8/111 |
| 5,904,734 | A | 5/1999 | Friberg et al. | 8/111 |
| 6,074,437 | A | 6/2000 | Racheria et al. | 8/111 |
| 2001/0012825 | A1 | 8/2001 | Hage | 510/367 |

FOREIGN PATENT DOCUMENTS

| | | |
|---|---|---|
| WO | 2005/121296 | 12/2005 |

OTHER PUBLICATIONS

PCT International Search Report in a PCT application PCT/EP2006/000509, (Apr. 2006).
GB Search Report in a GB application GB 0504440.9, (Jun. 2005).
Salles et al., "*Novel di-and trinuclear oxoperoxosulfato species in molybdenum (VI) and tungsten VI chemistry: the key role of pairs of bridging peroxo group*", Bulletin de la Societe Chimique de France, vol. 133, No. 4, 1996 (pp. 319-328), (Mar. 1996).

*Primary Examiner*—Gregory R Del Cotto
(74) *Attorney, Agent, or Firm*—Sterne, Kessler, Goldstein & Fox P.L.L.C

(57) ABSTRACT

The present invention provides a laundry treatment composition comprising a transition metal compound.

13 Claims, No Drawings

BLEACHING COMPOSITIONS

FIELD OF INVENTION

This invention relates to a bleaching composition comprising a transition metal peroxo compound.

BACKGROUND OF THE INVENTION

U.S. Pat. No. 5,904,734, to S.C. Johnson, discloses bleaching systems that contain a peroxide and an activator. The activator is a tungsten containing compound, preferred compounds are sodium tungstate or tungstosilicic acid.

U.S. Pat. No. 5,041,142, to lever Bothers, bleaching compositions comprising monomer molybdenum or tungsten derived peroxymetallate bleach activators. The compositions are disclosed as comprising from about 1 to 60% of a peroxygen compound capable of yielding hydrogen peroxide.

U.S. Pat. No. 6,074,437, to Unilever, discloses a bleaching composition incorporating polyoxometalates and being free of any effective amount of a bleaching agent such as hydrogen peroxide, organic peracids, inorganic peracids, organic persalts, and inorganic persalts. Air is employed as a primary source of oxygen atoms for bleaching.

SUMMARY OF INVENTION

We have found that transition metal V-peroxo compounds having between two and seven transition metal ions may be prepared in an economical manner and have utility in bleaching of substrates.

The present invention provides a laundry treatment composition comprising:

(i) between 0.0001 and 5 wt % of a transition metal V-peroxo compound having between two and seven transition metal ions selected from molybdenum, tungsten and vanadium atoms, at least two transition metal ions linked via a bridge having a sulpher atom therein;

(ii) 1.5 to 60 wt % of a surfactant; and, (iii) balance adjuncts and carrier materials to 100 wt %.

There are two different modes of bleaching that may be effected with the bleaching composition of the present invention. One where an added peroxyl species (peroxyl mode) is present in the composition and one where the composition has little or is substantially devoid of a peroxygen bleach or a peroxy-based or peroxyl-generating bleach system (air mode).

The surfactant has an HLB (hydrophilic/lipophilic balance) greater that 5, more preferably greater than 10, and most preferably greater than 15. For a discussion of HLB the reader is directed to and article by Griffin, W. C. in J. Soc. Cosmetic Chemists Vol. 1 page 311, 1945 and Davies, J. T. and Rideal, E. K. in Interfacial Phenomena, Acad. Press, NY, 1961, pages 371 to 382. The HLB value requirement reflects the importance of the rate of solubility and dispersibility of the surfactant from the bleaching composition to the aqueous wash medium in conjunction with surface activity towards the substrate being washed. The composition comprises between 1.5 to 60 wt % of a surfactant, most preferably 10 to 30 wt %.

When the laundry treatment composition/bleaching composition is used in "air mode". The "air mode" compositions are substantially devoid of peroxyl species, except for the peroxo group bound to the transition metal ion. The transition metal complexes comprise a V-peroxide group, i.e., side on bound peroxide

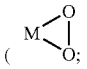

M=V, Mo, or W) and within the context of the present application are not considered to a peroxygen bleach or a peroxy-based or peroxyl-generating bleach system. In this regard, the "balance adjuncts and carrier materials to 100 wt %" and surfactant are "substantially devoid of a peroxygen bleach or a peroxy-based or peroxyl-generating bleach system" when acting as an "air mode" system.

The term "substantially devoid of a peroxygen bleach or a peroxy-based or peroxyl-generating bleach system" should be construed within the spirit of the invention. It is preferred that the composition has as low a content of peroxyl species present as possible. It is preferred that the bleaching formulation contains less that 1% wt/wt total concentration of peracid or hydrogen peroxide or source thereof, preferably the bleaching formulation contains less than 0.5% wt/wt, most preferably less than 0.3% wt/wt, total concentration of peracid or hydrogen peroxide or source thereof, most preferably the bleaching composition is devoid of peracid or hydrogen peroxide or source thereof. In addition, it is preferred that the presence of alkyl hydroperoxides is kept to a minimum in a composition.

When the laundry treatment composition/bleaching composition is used in "peroxyl mode" is preferred that the bleaching composition comprises between 2 to 50 wt % of a peroxygen compound capable of yielding hydrogen peroxide or source thereof.

The present invention extends to a method of bleaching a substrate/textile with the composition of the present invention. The method comprising the steps of treating a substrate with the bleaching composition in an aqueous environment, rinsing the substrate and drying the substrate.

A "unit dose" as used herein is a particular amount of the laundry treatment composition used for a type of wash, conditioning or requisite treatment step. The unit dose may be in the form of a defined volume of powder, granules or tablet or unit dose detergent liquid.

The present invention also extends to a commercial package together with instructions for its use.

The present invention also extends to an aqueous wash liquor comprising the bleaching composition. Upon addition of a unit dose to an aqueous wash medium it is preferred that, the aqueous medium has a pH in the range from pH 6 to 13, more preferably from pH 6 to 11, still more preferably from pH 8 to 11, and most preferably from pH 8 to 10, in particular from pH 9 to 10.5.

In the aqueous wash liquor the level of the transition metal V-peroxo compound is such that the in-use level is from 1 μM to 50 mM, with preferred in-use levels for domestic laundry operations falling in the range 1 μM to 100 μM. Higher levels may be desired and applied in industrial bleaching processes, such as textile and paper pulp bleaching.

In the aqueous wash liquor the level of surfactant present in the wash liquor is between 0.05 to 5 g/l, preferably between 0.1 to 2.5 g/l, most preferably 0.5 to 1.5 g/l.

The preferred medium for use of the bleaching composition is an aqueous medium. However, organic solvents may be used, for example, methanol or ethanol.

The bleaching composition of the present invention has particular application in detergent formulations, especially for laundry cleaning.

DETAILED DESCRIPTION OF THE INVENTION

The Transition Metal Peroxo Compound

The transition metal peroxo compound has a transition metal V-peroxide group. A transition metal peroxo V-peroxide group is of the form where M is the transition metal

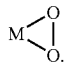

Preferred transition metal peroxo compounds are those having two (di-nuclear), three (tri-nuclear), four (tetra-nuclear) or five (penta-nuclear), six (hexa-nuclear) and seven (hept-nuclear) transition metal ions selected from molybdenum, tungsten and vanadium atoms. It is preferred that all the transition metals within the peroxo compound are the same. However, one skilled in the art will appreciate that mixed metal transition metal peroxo compound may be synthesised by using a mixture of the metal precursors, e.g., a mixture of molybdate and tungstate. A preferred class of transition metal peroxo compounds is transition metal oxo V-peroxo compounds

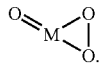

The followings is a preferred example of a peroxo compound:

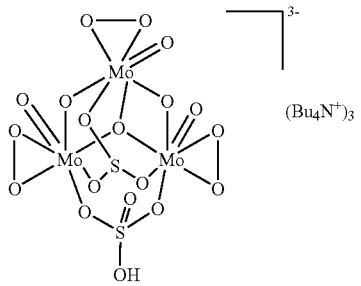

The above exemplified molybdenum V-peroxo compound is tri-nuclear and has a quaternary ammonium counter ion. The following are is another example of a molybdenum V-peroxo compound, a di-nuclear species which also comprises a end-on bound peroxy group, i.e., M—O—O—M:

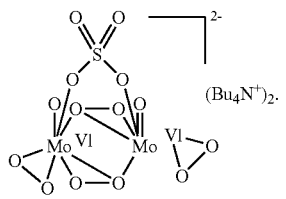

One can see from the examples above at least two transition metal ions are linked via a bridge having a sulpher atom therein. Bridging groups may be provided for by reaction of a suitable molybdenum, tungsten or vanadium compound with a sulphuric acid prior to oxidation with hydrogen peroxide. Preferred compounds are molybdate, vanadate, and tungstanate salts.

Generally, the transition metal peroxo compounds may be prepared by reaction of an alkali metal salt of the transition metal in aqueous medium with the acid followed by oxidation with hydrogen peroxide and subsequent addition of a cation. Generally, the desired transition metal peroxo compound precipitates out after addition of the cation and may be removed from the reaction mixture by filtration.

The number transition metals within the transition metal peroxo compound is controlled by varying the stoichiometry of the reagents used in synthesis.

The cation may be any type of a number of different cations, for example, metal ion cations such as $Na^+$, $K^+$, quaternary ammonium compounds such as $Me_3(C_{16})N^+$, $Me(C_8)_3N^+$, $Me_4N^+$, $Bu_3(C_{16})N^+$, $Bu_4N^+$, $Bu_4N^+$, $(C_{16})_4N^+$, $(C_{18})_2(CH_3)_2N^+$, $(C_8\text{-}C_{18})$ $(PhCH_2)$ $(CH_3)_2N^+$; and cationic nitriles. Preferred cations are surfactant cations. We have found that the cation influences the bleaching profile and efficacy in the two modes. Preferred cations are $Me(C_8)_3N^+$, and $Bu_4N^+$.

In many instances the synthesis may be performed as a one-pot synthesis. The ease of synthesis from inexpensive reactants allows the economic production of transition metal peroxo compound such that incorporation into laundry treatment composition is economically feasible at levels greater than that of compounds that have a relatively sophisticated synthetic procedure which employ expensive reactants and solvents, for example, some transition metal catalysts. In this regard, reference is made to complex 1, synthetic references given, and the synthesis of the transition metal peroxo compounds as found in the experimental section below.

The bleaching composition may be used as a pre-treatment composition for textiles and in this regard the pH of the pre-treatment may be in the range 3 to 8.

Balance Carriers and Adjunct Ingredients

The laundry treatment composition in addition to the bleaching composition comprises the balance carriers and adjunct ingredients to 100 wt % of the composition.

These may be, for example, builders, foam agents, anti-foam agents, further surfactants, solvents, perfumes, fluorescers, other bleaching agents, and enzymes. The use and amounts of these components are such that the composition performs depending upon economics, environmental factors and use of the composition.

When the bleaching composition is a fabric conditioner the bleaching composition comprises cationic surfactants. In this regard the pH of the aqueous rising formulation used to treat the textile may be as low as 4.

The composition comprises a surfactant and may optionally other conventional detergent ingredients. The composition may also comprise an enzymatic detergent composition which comprises from 0.1 to 50 wt %, based on the total detergent composition, of one or more surfactants. This surfactant system may in turn comprise 0 to 95 wt % of one or more anionic surfactants and 5 to 100 wt % of one or more nonionic surfactants. The surfactant system may additionally contain amphoteric or zwitterionic detergent compounds, but this in not normally desired owing to their relatively high cost. The enzymatic detergent composition according to the invention will generally be used as a dilution in water of about 0.05 to 2 wt %.

In general, the nonionic and anionic surfactants of a surfactant system may be chosen from the surfactants described "Surface Active Agents" Vol. 1, by Schwartz & Perry, Interscience 1949, Vol. 2 by Schwartz, Perry & Berch, Interscience 1958, in the current edition of "McCutcheon's Emulsifiers and Detergents" published by Manufacturing Confectioners Company or in "Tenside-Taschenbuch", H. Stache, 2nd Edn., Carl Hauser Verlag, 1981.

Suitable nonionic detergent compounds which may be used include, in particular, the reaction products of compounds having a hydrophobic group and a reactive hydrogen atom, for example, aliphatic alcohols, acids, amides or alkyl phenols with alkylene oxides, especially ethylene oxide either alone or with propylene oxide. Specific nonionic detergent compounds are $C_6$ to $C_{22}$ alkyl phenol-ethylene oxide condensates, generally 5 to 25 EO, i.e. 5 to 25 units of ethylene oxide per molecule, and the condensation products of aliphatic $C_8$ to $C_{18}$ primary or secondary linear or branched alcohols with ethylene oxide, generally 5 to 40 EO.

Suitable anionic detergent compounds which may be used are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher $C_8$ to $C_{18}$ alcohols, produced for example from tallow or coconut oil, sodium and potassium alkyl $C_9$ to $C_{20}$ benzene sulphonates, particularly sodium linear secondary alkyl $C_{10}$ to $C_{15}$ benzene sulphonates; and sodium alkyl glyceryl ether sulphates, especially those ethers of the higher alcohols derived from tallow or coconut oil and synthetic alcohols derived from petroleum. The preferred anionic detergent compounds are sodium $C_{11}$ to $C_{15}$ alkyl benzene sulphonates and sodium $C_{12}$ to $C_{18}$ alkyl sulphates. Also applicable are surfactants such as those described in EP-A-328 177 (Unilever), which show resistance to salting-out, the alkyl polyglycoside surfactants described in EP-A-070 074, and alkyl monoglycosides.

Preferred surfactant systems are mixtures of anionic with nonionic detergent active materials, in particular the groups and examples of anionic and nonionic surfactants pointed out in EP-A-346 995 (Unilever). Especially preferred is surfactant system that is a mixture of an alkali metal salt of a $C_{16}$ to $C_{18}$ primary alcohol sulphate together with a $C_{12}$ to $C_{15}$ primary alcohol 3 to 7 EO ethoxylate.

The nonionic detergent is preferably present in amounts greater than 10%, e.g. 25 to 90 wt % of the surfactant system. Anionic surfactants can be present for example in amounts in the range from about 5% to about 40 wt % of the surfactant system.

Cationic Compound

When the present invention is used as a fabric conditioner it needs to contain a cationic compound. This is a preferred format in "air mode".

Most preferred are quaternary ammonium compounds.

It is advantageous if the quaternary ammonium compound is a quaternary ammonium compound having at least one $C_{12}$ to $C_{22}$ alkyl chain.

It is preferred if the quaternary ammonium compound has the following formula:

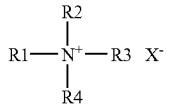

in which $R^1$ is a $C_{12}$ to $C_{22}$ alkyl or alkenyl chain; $R^2$, $R^3$ and $R^4$ are independently selected from $C_1$ to $C_4$ alkyl chains and $X^-$ is a compatible anion. A preferred compound of this type is the quaternary ammonium compound cetyl trimethyl quaternary ammonium bromide.

A second class of materials for use with the present invention are the quaternary ammonium of the above structure in which $R^1$ and $R^2$ are independently selected from $C_{12}$ to $C_{22}$ alkyl or alkenyl chain; $R^3$ and $R^4$ are independently selected from $C_1$ to $C_4$ alkyl chains and $X^-$ is a compatible anion.

A detergent composition according to claim 1 in which the ratio of (ii) cationic material to (iv) anionic surfactant is at least 2:1.

Other suitable quaternary ammonium compounds are disclosed in EP 0 239 910 (Proctor and Gamble).

It is preferred if the ratio of cationic to nonionic surfactant is from 1:100 to 50:50, more preferably 1:50 to 20:50.

The cationic compound may be present from 1.5 wt % to 50 wt % of the total weight of the composition. Preferably the cationic compound may be present from 2 wt % to 25 wt %, a more preferred composition range is from 5 wt % to 20 wt %.

Builder

The bleaching composition of the present invention preferably comprises one or more detergency builders. The total amount of detergency builder in the compositions will preferably range from 5 to 80 wt %, more preferably from 10 to 60 wt %.

Inorganic builders that may be present include sodium carbonate, if desired in combination with a crystallisation seed for calcium carbonate, as disclosed in GB 1 437 950 (Unilever); crystalline and amorphous aluminosilicates, for example, zeolites as disclosed in GB 1 473 201 (Henkel), amorphous aluminosilicates as disclosed in GB 1 473 202 (Henkel) and mixed crystalline/amorphous aluminosilicates as disclosed in GB 1 470 250 (Procter & Gamble); and layered silicates as disclosed in EP 164 514B (Hoechst). Inorganic phosphate builders, for example, sodium orthophosphate, pyrophosphate and tripolyphosphate are also suitable for use with this invention.

The compositions of the invention preferably contain an alkali metal, preferably sodium, aluminosilicate builder. Sodium aluminosilicates may generally be incorporated in amounts of from 10 to 70% by weight (anhydrous basis), preferably from 25 to 50 wt %.

The alkali metal aluminosilicate may be either crystalline or amorphous or mixtures thereof, having the general formula: 0.8-1.5 $Na_2O$. $Al_2O_3$. 0.8-6 $SiO_2$.

These materials contain some bound water and are required to have a calcium ion exchange capacity of at least 50 mg CaO/g. The preferred sodium aluminosilicates contain 1.5-3.5 $SiO_2$ units (in the formula above). Both the amorphous and the crystalline materials can be prepared readily by reaction between sodium silicate and sodium aluminate, as amply described in the literature. Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof.

The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP 384 070A (Unilever). Zeolite MAP is defined as an alkali metal aluminosilicate of the zeolite P type having a silicon to aluminium ratio not exceeding 1.33, preferably within the range of from 0.90 to 1.33, and more preferably within the range of from 0.90 to 1.20.

Especially preferred is zeolite MAP having a silicon to aluminium ratio not exceeding 1.07, more preferably about 1.00. The calcium binding capacity of zeolite MAP is generally at least 150 mg CaO per g of anhydrous material.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di and trisuccinates, carboxymethyloxy succinates, carboxymethyloxymalonates, dipicolinates, hydroxyethyliminodiacetates, alkyl- and alkenylmalonates and succinates; and sulphonated fatty acid salts. This list is not intended to be exhaustive.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Peroxy Species or Source Thereof

In "peroxyl mode" the composition of the present invention uses an added peroxyl species to bleach a substrate. The peroxy bleaching species may be a compound which is capable of yielding hydrogen peroxide in aqueous solution. Hydrogen peroxide sources are well known in the art. They include the alkali metal peroxides, organic peroxides such as urea peroxide, and inorganic persalts, such as the alkali metal perborates, percarbonates, perphosphates persilicates and persulphates. Mixtures of two or more such compounds may also be suitable. The peroxygen compound preferably yields hydrogen peroxide in an aqueous medium in the range 0.001 μM to 50 μM when used per unit dose.

Particularly preferred are sodium perborate tetrahydrate and, especially, sodium perborate monohydrate. Sodium perborate monohydrate is preferred because of its high active oxygen content. Sodium percarbonate may also be preferred for environmental reasons. The amount thereof, or other source, in the composition of the invention usually will preferably be within the range of about 2 to 35% by weight, more preferably from 5 to 25% by weight. One skilled in the art will appreciate that these amounts may be reduced in the presence of a bleach precursor e.g., N,N,N'N'-tetraacetyl ethylene diamine (TAED).

Another suitable hydrogen peroxide generating system is a combination of a C1-C4 alkanol oxidase and a C1-C4 alkanol, especially a combination of methanol oxidase (MOX) and ethanol. Such combinations are disclosed in International Application PCT/EP 94/03003 (Unilever), which is incorporated herein by reference.

Alkylhydroxy peroxides are another class of peroxy bleaching compounds. Examples of these materials include cumene hydroperoxide and t-butyl hydroperoxide.

Organic peroxyacids may also be suitable as the peroxy bleaching compound. Such materials normally have the general formula:

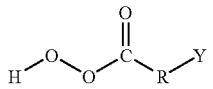

wherein R is an alkylene or substituted alkylene group containing from 1 to about 20 carbon atoms, optionally having an internal amide linkage; or a phenylene or substituted phenylene group; and Y is hydrogen, halogen, alkyl, aryl, an imido-aromatic or non-aromatic group, a COOH or

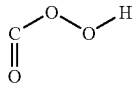

group or a quaternary ammonium group.

Typical monoperoxy acids useful herein include, for example:

(i) peroxybenzoic acid and ring-substituted peroxybenzoic acids, e.g. peroxy-.alpha.-naphthoic acid;

(ii) aliphatic, substituted aliphatic and arylalkyl monoperoxyacids, e.g. peroxylauric acid, peroxystearic acid and N,N-phthaloylaminoperoxy caproic acid (PAP); and (iii) 6-octylamino-6-oxo-peroxyhexanoic acid.

Typical diperoxyacids useful herein include, for example:

(iv) 1,12-diperoxydodecanedioic acid (DPDA);

(v) 1,9-diperoxyazelaic acid;

(vi) diperoxybrassilic acid; diperoxysebasic acid and diperoxyisophthalic acid;

(vii) 2-decyldiperoxybutane-1,4-diotic acid; and (viii) 4,4'-sulphonylbisperoxybenzoic acid.

Also inorganic peroxyacid compounds are suitable, such as for example potassium monopersulphate (MPS). If organic or inorganic peroxyacids are used as the peroxygen compound, the amount thereof will normally be within the range of about 2-10% by weight, preferably from 4-8% by weight.

Peroxyacid bleach precursors are known and amply described in literature, such as in the British Patents 836988; 864,798; 907,356; 1,003,310 and 1,519,351; German Patent 3,337,921; EP-A-0185522; EP-A-0174132; EP-A-0120591; and U.S. Pat. Nos. 1,246,339; 3,332,882; 4,128,494; 4,412,934 and 4,675,393.

Another useful class of peroxyacid bleach precursors is that of the cationic i.e. quaternary ammonium substituted peroxyacid precursors as disclosed in U.S. Pat. Nos. 4,751,015 and 4,397,757, in EP-A0284292 and EP-A-331,229. Examples of peroxyacid bleach precursors of this class are:

2-(N,N,N-trimethyl ammonium) ethyl sodium-4-sulphonphenyl carbonate chloride (SPCC);

N-octyl-N,N-dimethyl-N10-carbophenoxy decyl ammonium chloride (ODC);

3-(N,N,N-trimethyl ammonium) propyl sodium-4-sulphophenyl carboxylate; and

N,N,N-trimethyl ammonium toluyloxy benzene sulphonate.

A further special class of bleach precursors is formed by the cationic nitriles as disclosed in EP-A-303,520 and in European Patent Specification No.'s 458,396 and 464,880.

Any one of these peroxyacid bleach precursors can be used in the present invention, though some may be more preferred than others.

Of the above classes of bleach precursors, the preferred classes are the esters, including acyl phenol sulphonates and acyl alkyl phenol sulphonates; the acyl-amides; and the quaternary ammonium substituted peroxyacid precursors including the cationic nitriles.

Examples of said preferred peroxyacid bleach precursors or activators are sodium-4-benzoyloxy benzene sulphonate (SBOBS); N,N,N'N'-tetraacetyl ethylene diamine (TAED); sodium-1-methyl-2-benzoyloxy benzene-4-sulphonate; sodium-4-methyl-3-benzoloxy benzoate; SPCC; trimethyl ammonium toluyloxy-benzene sulphonate; sodium nonanoyloxybenzene sulphonate (SNOBS); sodium 3,5,5-trimethyl hexanoyl-oxybenzene sulphonate (STHOBS); and the substituted cationic nitriles.

Other classes of bleach precursors for use with the present invention are found in WO0015750, for example 6-(nonanamidocaproyl)oxybenzene sulphonate.

The precursors may be used in an amount of up to 12%, preferably from 2-10% by weight, of the composition.

The bleaching compositions according to the present invention may be used for laundry cleaning, hard surface cleaning (including cleaning of lavatories, kitchen work surfaces, floors, mechanical ware washing, etc.), as well as other uses where a bleach is needed, for example waste water treatment or pulp bleaching during manufacture of paper, dye transfer inhibition, starch bleaching, sterilisation and/or whitening in oral hygiene preparation, or contact lens disinfection.

The bleaching composition may comprise other bleach catalysts, for example complex 1 as found in the experimental below. Other bleaching catalysts that may be present in the composition are, for example, found in WO00/12667, WO01/48299, WO02/48301, and WO03/104234.

The invention will now be further illustrated by way of the following non-limiting examples:

EXPERIMENTAL

The following complexes were used for comparison with transition metal peroxo compounds.

Complex 1, [FeCl(N2Py2EtNMe2)]C1], is the transition metal complex formed between iron chloride and a ligand of the following structure:

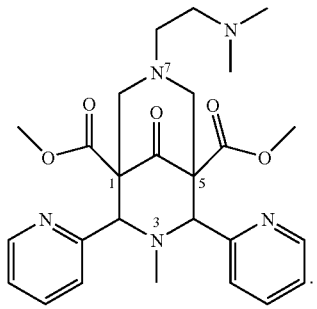

The name of the ligand is (dimethyl 2,4-di-(2-pyridyl)-3-methyl-7-(N,N-dimethylaminoethylene)-3,7-diaza-bicyclo [3.3.1]nonan-9-one-1,5-dicarboxylate). The synthesis of this compound is provided for in WO03/104234.

Synthesis of Transition Metal Peroxo Compounds

Molybdenum-Hexamer (Mo-6)

$[(C_2H_5)_4N]_4[(\mu_3\text{-}SO_4)_2\text{-}(\mu_3\text{-}O)_2\text{-}(\mu_2\text{-}O)_7\text{—}Mo_4O_4(O_2)_4 Mo_2O_2].14H_2O$ To the solution of $Na_2MoO_4.2H_2O$ (2.18 g, 9 mmol) dissolved in 5 mL $H_2O$, $H_2SO_4$ (98%, 0.6 mL) and 30% $H_2O_2$ (2.4 mL, 21 mmol) were slowly added dropwise. After stirred for 15 minutes, $(C_2H_5)_4NCl$ (2.6 g, 15.6 mmol) dissolved in 5 mL water was added at room temperature. The yellow solids precipitated at room temperature were filtered off and washed with cool water (1×5 mL) and ether (3×5 mL). After dried in $P_2O_5$ in vacuum, the complex was obtained as yellow crystal (yield in 74%). $^1H$ NMR ($D_2O$, 400 MHz) δ: 1.25 (t, J=7.3 Hz, 48H, $CH_3$), 3.25 (q, J=7.3 Hz, 32H, $CH_2$). IR (KBr pellet): 3413br, 2990m, 2953m, 1647w, 1487s, 1459w, 1394m, 1210m, 1174s, 1125s, 1053m, 974vs, 946s, 914vs, 785m, 730m, 618vs, 508s, 434w $cm^{-1}$. Anal. calcd. for $C_{32}H_{108}Mo_6N_4O_{45}S_2$: C, 20.13, H, 5.70, N, 2.93; Found: C, 19.87, H, 5.33, N, 3.09%.

Molybdenum-Trimer (Mo-3A)

$[(n\text{-}C_4H_9)_4N]_3[(\mu_3\text{-}SO_4)\text{-}(\mu_2\text{-}HSO_4)\text{-}(\mu_3\text{-}O)\text{-}(\mu_2\text{-}O)_2\text{—}Mo_3O_3(O_2)_3]$ To a solution of $Na_2MoO_4.2H_2O$ (2.18 g, 9 mmol) dissolved in 5 mL $H_2O$, $H_2SO_4$ (98%, 0.6 mL, 10.8 mmol) and 30% $H_2O_2$ (2.4 mL, 21 mmol) were slowly added dropwise simultaneously to give a yellow solution. After stirred for 15 minutes, $(n\text{-}C_4H_9)_4N(HSO_4)$ (5.3 g, 15.6 mmol) dissolved in 5 mL water was added at room temperature. The yellow solids precipitated at room temperature were filtered off and washed with cool water (3×5 mL) and ether (3×5 mL). After dried in P2O5 in vacuum, the complex was obtained as yellow powdery solids (3.94 g, yield in 94%). $^1H$ NMR ($D_2O$, 400 MHz) δ: 0.83 (t, J=7.4 Hz, 36H, $CH_3$), 1.20-1.29 (m, 24H, $CH_2$), 1.50-1.58 (m, 24H, $CH_2$), 3.08 (t, J=8.5 Hz, 24H, $CH_2$). IR (KBr pellet): 3423br, 2962s, 2874s, 1626w, 1485s, 1382m, 1116s, 975vs, 883m, 815vs, 739w, 619s, 554w, 446m $cm^{-1}$. Anal. calcd. for $C_{48}H_{109}Mo_3N_3O_{20}S_2$: C, 41.17, H, 7.85, N, 3.00; Found: C, 41.13, H, 7.74, N, 2.92%.

Molybdenum-Trimer (Mo-3B)

$[(CH_3)_4N]_3[(\mu_3\text{-}SO_4)\text{-}(\mu_2\text{-}HSO_4)\text{-}(\mu_3\text{-}O)\text{-}(\mu_2\text{-}O)_2\text{—}Mo_3O_3(O_2)_3].3.5H_2O$ To a solution of $Na_2MoO_4.2H_2O$ (1.09 g, 4.5 mmol) dissolved in 3 mL $H_2O$, $H_2SO_4$ (98%, 0.3 mL, 5.4 mmol) and 30% $H_2O_2$ (1.2 mL, 10.5 mmol) were slowly added dropwise simultaneously to give a yellow solution. After stirred for 15 minutes, $(CH_3)_4N(HSO_4)$ (1.48 g, 7.8 mmol) dissolved in 3 mL water was added at room temperature. The yellow crystals were precipitated within a few days at room temperature, which were filtered off and washed with cool water (3×5 mL) and ether (3×5 mL). After dried in $P_2O_5$ in vacuum, the complex was obtained as yellow crystals (0.76 g, yield in 62%), and characterized by X-ray single crystal diffraction. $^1H$ NMR ($D_2O$, 400 MHz) δ: 3.18 (s, 36H, $CH_3$). IR (KBr pellet): 3468br, 3040m, 2962w, 1636w, 1488s, 1263m, 1208m, 1140vs, 1086vs, 987m, 964vs, 917s, 696m, 674m, 624s, 599m, 552s, 436w $cm^{-1}$. Anal. calcd. for $C_{12}H_{44}Mo_3N_3O_{23.5}S_2$: C, 15.04, H, 4.63, N, 4.38; Found: C, 14.94, H, 4.82, N, 4.30%.

Molybdenum Dimer (Mo-2)

$[(n\text{-}C_4H_9)_4N]_2[(\mu_2\text{-}SO_4)\text{-}(\mu_2\text{-}O_2)_2\text{—}Mo_2O_2(O_2)_2].7H_2O$ (From: Salles, L.; Robert, F.; Semmer, V.; Jeannin, Y.; Bregeault, J-M. Bull Soc. Chim. Fr. (1996) 133, 319-328) To the solution of $Na_2MoO_4.2H_2O$ (3.39 g, 14 mmol) dissolved in 10 mL $H_2O$, 2 M $H_2SO_4$ (5 mL) was added dropwise and stirred for 15 minutes at room temperature. And, 30% $H_2O_2$ (8.5 mL, 76.5 mmol) was added dropwise to give a yellow solution at room temperature. After stirred for 20 minutes, $(n\text{-}C_4H_9)_4NCl$ (4.17 g, 15 mmol) dissolved in 5 mL water was added. The yellow solid precipitated in the solution were filtered off and washed with cool water (3×5 mL) and ether (3×5 mL). After dried in $P_2O_5$ in vacuum, the complex was obtained as yellow powdery solids (5.17 g, yield in 79%). $^1H$ NMR ($D_2O$, 400 MHz) δ: 0.95 (t, J=7.3 Hz, 24H, $CH_3$), 1.33-1.39 (m, 16H, $CH_2$), 1.63-1.65 (m, 16H, $CH_2$), 3.20 (t, J=8.3 Hz, 16H, $CH_2$). IR (KBr pellet): 3442vs, 2962vs, 2873s, 1632m, 1484vs, 1399m, 1151w, 1107w, 1068w, 960s, 867s, 678m, 587s $cm^{-1}$. Anal. Calcd. for $C_{32}H_{86}Mo_2N_2O_{21}S$: C, 36.29, H, 8.19, N, 2.65; Found: C, 36.20, H, 8.02, N, 2.64%.

Tungsten Hexamer (W-6)

$[(CH_3)_4N]_4[(\mu_3\text{-}SO_4)_2\text{-}(\mu_3\text{-}O)_2\text{-}(\mu_2\text{-}O)_7\text{—}W_4O_4(O_2)_4W_2O_2]$ To the solution of $Na_2WO_4.2H_2O$ (3.08 g, 9.3 mmol) dissolved in 6 mL $H_2O$, $H_2SO_4$ (98%, 0.6 mL, 10.8 mmol) and 30% $H_2O_2$ (2.4 mL, 21 mmol) were slowly added dropwise. After stirred for 15 minutes, $(CH_3)_4N(HSO_4)$ (3 g, 15.8 mmol) dissolved in 6 mL water was added at room temperature. The yellow crystals precipitated at room temperature were filtered off and washed with cool water (1×5 mL) and ether (3×5 mL). After dried in $P_2O_5$ in vacuum, complex was obtained as yellow crystal (yield in 62%), and characterized by X-ray single crystal diffraction. $^1H$ NMR ($D_2O$, 400 MHz) δ: 3.19 (s, 48H, $CH_3$). IR (KBr pellet): 3041s, 2212w, 1655w, 1489s, 1289w, 1209vs, 1124s, 1058vs, 978vs, 953vs, 895m, 874vs, 846vs, 769s, 696s, 645s, 629s, 615s, 551s, 536s, 455w, 417m $cm^{-1}$. Anal. calcd. for $C_{16}H_{48}W_6N_4O_{31}S_2$: C, 9.81, H, 2.47, N, 2.86; Found: C, 9.86, H, 2.59, N, 2.83%.

Tungsten Trimer (W-3)

$[(n\text{-}C_4H_9)_4N]_3[(\mu_3\text{-}SO_4)\text{-}(\mu_2\text{-}HSO_4)\text{-}(\mu_3\text{-}O)\text{-}(\mu_2\text{-}O)_2\text{—}W_3O_3(O_2)_3]$ To the solution of $Na_2WO_4.2H_2O$ (3.08 g, 9.3 mmol) dissolved in 5 mL $H_2O$, $H_2SO_4$ (98%, 0.6 mL, 10.8 mmol) and 30% $H_2O_2$ (2.4 mL, 21 mmol) were slowly added dropwise. After stirred for 15 minutes, $(n\text{-}C_4H_9)_4N(HSO_4)$ (5.3 g, 15.6 mmol) dissolved in 5 mL water was added at room temperature. The white solids precipitated at room temperature were filtered off and washed with cool water(3×5 mL) and ether (3×5 mL). After dried in $P_2O_5$ in vacuum, the target complex was obtained as buff powdery solids (2.89 g, yield in 56%). $^1H$ NMR($D_2O$, 400 MHz) δ: 0.91 (t, J=7.4 Hz, 36H, $CH_3$), 1.27-1.36 (m, 24H, $CH_2$), 1.57-1.65 (m, 24H, $CH_2$), 3.16 (t, J=8.5 Hz, 24H, $CH_2$). IR (KBr pellet): 3435br, 2962vs, 2874s, 1635w, 1476s, 1386m, 1287s, 1154vs, 1118s, 967vs, 874vs,822w, 742w, 591s $cm^{-1}$. Anal. calcd. for $C_{48}H_{109}W_3N_3O_{20}S_2$: C, 34.65, H, 6.60, N, 2.53; Found: C, 35.40, H, 6.98, N, 2.51%.

Bleaching Experiments

The following formulations were used in the experiments with hydrogen peroxide and/or a transition metal peroxo compound/transition metal catalyst. The amount in parenthesis beside the percentage given for a particular component in the formulation is the amount of the component calculated to be dosed the aqueous wash solution.

| Solid Formulation A | |
|---|---|
| NaLAS (surfactant) | 21% (0.42 g/l) |
| Cationic surfactant | 0.7% (0.014 g/l) |
| Zeolite builder | 0.2% (0.004 g/l) |
| Sodium silicate | 7% (0.14 g/l) |
| Sodium-STP | 13% (0.26 g/l) |
| Sodium sulphate | 34% (0.68 g/l) |
| Sodium carbonate | 15% (0.3 g/l) |
| Minors (fluorescer, anti-redeposition polymer, dye) | >1% |
| Water | 6.9% |

| Solid Formulation B | |
|---|---|
| NaLAS | 8.14% (0.4 g/l) |
| Nonionic 7EO | 6.36% (0.32 g/l) |
| Soap | 1% (0.05 g/l) |
| Fatty acid | 0.65% (0.032 g/l) |
| Copolymer CP5 | 1.2% (0.6 g/l) |
| Zeolite A24 | 19.2% (0.95 g/l) |
| Na carbonate | 16.9% (0.85 g/l) |
| Na sulphate | 18.7% (0.94 g/l) |
| Na-disilicate | 3.2% 0.16 g/l) |
| Citric acid | 2.45% (0.12 g/l) |
| Sequesterent | 1.04 (0.063 g/l) |
| Minors: fluorescer and antifoam | — |

| Liquid detergent formulation (LDF) | |
|---|---|
| Nonionic 9EO | 4.50% (0.36 g/l) |
| Fatty acid 5908 | 1.25% (0.11 g/l) |
| LAS acid | 4.50% (0.36 g/l) |
| SLES 3EO | 4.50% (0.36 g/l) |
| NaOH solution (50%) | 1.08% (0.086 g/l) |
| Boric acid (100%) | 0.65% (0.052 g/l) |
| Sorbitol (70%) | 3.35% (0.27 g/l) |
| Xylenesulphonic acid sodium salt (hydrotrope) | 1.50% (0.075 g/l) |
| Water | 78.63% |

The formulations were initially dissolved in water in the following amounts: Solid Formulation A: 2 g/l in 6 FH water hardness, Solid Formulation B: 5 g/l in 19 FH hardness, and Liquid Detergent Formulation: 8 g/l in 27 FH hardness.

Bleaching results obtained for the respective stains with the transition metal peroxo compound or comparative transition metal complex in an aqueous solution of solid formulation A, solid formulation B or liquid detergent formulation for 30 min at 30° C. in a bottle containing 25 ml of the wash solution. Control experiments were carried out as indicated in the tables found below.

After the washes, the cloths were rinsed with water and subsequently dried at 30° C. and the change in colour was measured immediately after drying for 3 h at 45° C. with a Linotype-Hell scanner (ex Linotype). The change in colour (including bleaching) is typically expressed as the ΔE value. The value of DealaE can be expressed in two different ways, one which is called $DeltaE_{AW\text{-}B}$ which is the difference between a washed, stained cloth and a white, unstained cloth. For these measurements, the smaller the $DeltaE_{AW\text{-}B}$ value, the cleaner the cloth. Alternatively, ΔE can be expressed as the difference between a stained cloth, before being washed, and after being washed (DeltaE$_{AW\text{-}BW}$). In this case, the larger the colour difference, the cleaner the cloth (a higher dealtaE$_{AW\text{-}BW}$ means a cleaner cloth). The measured colour difference ($\Delta E_{AW\text{-}BW}$) between the washed cloth and the unwashed cloth is defined as follows:

$$\Delta E_{AW\text{-}BW}=[(\Delta L_{AW\text{-}BW})^2+(\Delta a_{AW\text{-}BW})^2+(\Delta b_{AW\text{-}BW})^2]^{1/2}$$

wherein $\Delta L_{AW\text{-}BW}$ is a measure for the difference in darkness between the washed and unwashed test cloth; $\Delta a_{AW\text{-}BW}$ and $\Delta b_{AW\text{-}BW}$ are measures for the difference in redness and yellowness respectively between both cloths. With regard to this colour measurement technique, reference is made to Commission International de l'Eclairage (CIE); Recommendation on Uniform Colour Spaces, colour difference equations, psychometric colour terms, supplement no 2 to CIE Publication, no 15, Colormetry, Bureau Central de la CIE, Paris 1978. The results are shown below in the tables and are listed. In the tables below the bleaching effect is expressed in the form of a stain removal index (SRI): SRI=100-DeltaE$_{AW\text{-}B}$.

Results in Air-Mode
Bleaching results on tomato oil stained cotton

| Compound | SRI in B | SRI in LDF | SRI in A |
|---|---|---|---|
| Complex 1 | 84.6 | 90.2 | 91.3 |
| Mo-SA $Bu_4N^+$ | 88.1 | 90.4 | 88.2 |
| W-3 $Bu_4N^+$ | 84.7 | 85.5 | 84.5 |
| Control (no Cat.) | 74.8 | 74.6 | 76.3 |

Results in Peroxide-Mode
Bleaching results on curry oil stain

| Compound | SRI in B 1 mM $H_2O_2$ | SRI in B 10 mM $H_2O_2$ | SRI in A 10 mM $H_2O_2$ |
|---|---|---|---|
| Complex 1 | 67.56 | 63.54 | 60.31 |
| Mo-3 $Bu_4N^+$ | 51.55 | 45.98 | 43.55 |
| Control (no Cat.) | 45.63 | 43.45 | 38.53 |
| Complex 1 | 63.7 | 60.5 | 54.1 |
| Mo-3 $Me(C_8)_3N^+$ | 47.1 | 42.9 | 35.0 |
| Control (no Cat.) | 40.4 | 33.9 | 34.0 |

We claim:

1. A laundry treatment composition comprising:

(i) between 0.0001 and 5 wt % of a transition metal V-peroxo compound which comprises the group

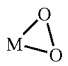

wherein M is molybdenum, tungsten, or vanadium, further wherein said compound has between two and seven transition metal ions selected from molybdenum, tungsten and vanadium atoms, at least two transition metal ions linked via a bridge having a sulpher atom therein;

(ii) 1.5 to 60 wt % of a surfactant; and, (iii) balance adjuncts and carrier materials to 100 wt %.

2. A laundry treatment composition according to claim 1, wherein the composition comprises a molybdenum V-peroxo compound.

3. A laundry treatment composition according to claim 2, wherein the molybdenum V-peroxo compound has between two and five Mo ions.

4. A laundry treatment composition according to claim 3, wherein the molybdenum V-peroxo compound is a molybdenum trimer.

5. A laundry treatment composition according to claim 1, wherein the transition metal V-peroxo compound has a cation selected from the group consisting of: an alkali metal, a quaternary ammonium compound, a cationic nitrile, and a cationic surfactant.

6. A laundry treatment composition according to claim 5, wherein the transition metal V-peroxo compound has a cation which is a cationic surfactant.

7. A laundry treatment composition according to claim 1, wherein the laundry treatment composition is a granular laundry detergent composition.

8. A laundry treatment composition according to claim 1, wherein the laundry treatment composition is liquid detergent composition.

9. A laundry treatment composition according to claim 1, wherein the composition further comprises a builder in the range of from 5 to 80 wt %.

10. A laundry treatment composition according to claim 1, wherein the transition metal V-peroxo compound is a transition metal oxo V-peroxo compound.

11. A laundry treatment composition according to claim 10 wherein transition metal V-peroxo compound is selected from the group consisting of: $[(\mu_3\text{-}SO_4)_2\text{-}(\mu_3\text{-}O)_2\text{-}(\mu_2\text{-}O)_7\text{—}Mo_4O_4(O_2)_4Mo_2O_2]^{4-}$, $[(\mu_3\text{-}SO_4)_2\text{-}(\mu_3\text{-}O)_2\text{-}(\mu_2\text{-}O)_7\text{—}W_4O_4(O_2)_4W_2O_2]^{4-}$, $[(\mu_3\text{-}SO_{04})\text{-}(\mu_2\text{-}HSO_4)\text{-}(\mu_3\text{-}O)\text{-}(\mu_2\text{-}O)_2\text{—}Mo_3O_3(O_2)_3]$, and $[(\mu_3\text{-}SO_4)\text{-}(\mu_2\text{-}HSO_4)\text{-}(\mu_3\text{-}O)\text{-}(\mu_2\text{-}O)_2\text{—}W_3O_6(O_2)_3]^{3-}$, wherein the transition metal V-peroxo compound is in the form of a salt with a cation.

12. A method of bleaching a textile comprising the following steps:

(i) treating a textile with the composition according to claim 1 in an aqueous medium, wherein the aqueous medium comprises between 1 μM to 50 mM of the transition metal V-peroxo compound and has a pH in the range 4 to 13;

(ii) rinsing the textile with water; and, (iii) drying the textile.

13. An aqueous wash liquor comprising the laundry treatment composition according to claim 1, wherein the transition metal V-peroxo compound is present in the range 1 μM to 50 mM and the level of surfactant present in the wash liquor is between 0.05 to 5 g/l.

* * * * *